US005632654A

United States Patent [19]

Sugiura

[11] Patent Number: 5,632,654

[45] Date of Patent: May 27, 1997

[54] FUSE CONNECTION STRUCTURE

[75] Inventor: Tomohiro Sugiura, Shizuoka, Japan

[73] Assignee: Yazaki Corporation, Tokyo, Japan

[21] Appl. No.: 588,375

[22] Filed: Jan. 18, 1996

[30] Foreign Application Priority Data

Jan. 20, 1995 [JP] Japan ..... 7-007660

[51] Int. Cl.[6] ..... H01R 13/64; H01H 85/02

[52] U.S. Cl. ..... 439/621; 337/186; 337/201

[58] Field of Search ..... 439/621, 622; 337/186, 187, 201, 208

[56] References Cited

U.S. PATENT DOCUMENTS

| | | | |
|---|---|---|---|
| 4,221,455 | 9/1980 | Cairns et al. | 339/186 |
| 4,238,140 | 12/1980 | Cairns et al. | 339/186 |
| 4,560,227 | 12/1985 | Bukala | 339/147 |
| 5,145,414 | 9/1992 | Oikawa | 439/621 |
| 5,171,293 | 12/1992 | Umemoto et al. | 439/622 |
| 5,215,479 | 6/1993 | Araki et al. | 439/622 |
| 5,221,217 | 6/1993 | Oikawa | 439/621 |
| 5,224,872 | 7/1993 | Noda et al. | 439/282 |
| 5,277,626 | 1/1994 | Oikawa et al. | 439/621 |
| 5,488,345 | 1/1996 | Seki et al. | 439/621 |

FOREIGN PATENT DOCUMENTS

| | | | |
|---|---|---|---|
| 2262667A | 6/1993 | European Pat. Off. | H01H 85/20 |
| 55-48687 | 3/1980 | Japan | H01H 85/00 |
| 3-50739 | 5/1991 | Japan | H01H 85/54 |
| 3-196440 | 8/1991 | Japan | H01H 85/22 |
| 3-95578 | 9/1991 | Japan | H01R 13/60 |
| 3-109257 | 11/1991 | Japan | H01H 85/56 |
| 4-8352 | 1/1992 | Japan | H01H 85/00 |
| 5-36771 | 5/1993 | Japan | H01R 13/52 |
| 5-159693 | 6/1993 | Japan | H01H 85/56 |

*Primary Examiner*—P. Austin Bradley
*Assistant Examiner*—T. C. Patel
*Attorney, Agent, or Firm*—Sughrue, Mion, Zinn, Macpeak & Seas

[57] ABSTRACT

A fuse connection structure which is capable of receiving and retaining standard fuses when dark current fuses are not used, in such a manner that the standard fuses are protected from external forces and are positively held in position. The fuse connection structure includes a fuse holder (1) having dark current fuses (8) mounted therein, and a fuse block body (7) to which the fuse holder can be attached, the fuse block body having connection terminals. The fuse holder (1) includes a dark current fuse insertion portion (5) holding widthwise opposite ends of the dark current fuses, a cover portion (6) provided outside of the fuse insertion portion, and ribs (2) and (3) interconnecting the fuse insertion portion and the cover portion. The fuse block body (7) has relief portions (16) for the ribs (2) and (3). The ribs (2) and (3) extend in a direction of a thickness of the dark current fuse relative to the dark fuse insertion portion (5). The fuse block body (7) has protective walls (10) opposed respectively to the widthwise opposite ends of each of the fuses such that the protective walls do not have the relief portion (16). The fuse block body (7) has fuse-fixing ribs (11) for acting on opposite sides of fuses, the opposite sides facing away from each other in a direction of a thickness of the fuse.

8 Claims, 6 Drawing Sheets

FUSE CONNECTION STRUCTURE

BACKGROUND OF THE INVENTION

1. Field of the Invention

This invention relates to a fuse connection structure in which when dark current fuses are not used, fuses for normal circuits are protected from an external force without the use of a fuse holder, and are positively held.

2. Related art

FIGS. 9 and 10 show a conventional fuse connection structure which includes a fuse holder 51 made of a synthetic resin and holding a plurality of dark current fuses 8 in a juxtaposed manner, and a fuse block body 52 made of a synthetic resin and being insertable into the fuse holder 51. The fuse block body 52 holds female connection terminals 13 which are respectively connected to male tab terminals 31 of the dark current fuses 8.

In order to prevent battery consumption during transport of vehicles for export purposes, the dark current fuses 8 are used for interrupting circuits for electronic parts, such as a clock, by withdrawing the fuse holder 51.

The fuse holder 51 includes an insertion portion 5 for receiving the dark current fuses 8, and a cover portion 6 disposed outside of the insertion portion 5. The insertion portion 5 is connected to the cover portion 6 by a plurality of ribs 53. The fuse insertion portion 5 is disposed at an upper half portion of the fuse holder 51. The ribs 53 are formed on each of right and left walls 54 of the insertion portion 5, and extend laterally in a direction of the width of the fuse 8 (that is, a direction of juxtaposition of the pair of male tab terminals 31). Relief slits 56 for receiving the respective associated ribs 53 are formed in each of right and left walls 55 of the fuse block body 52.

Retaining projections 19 and 20 are formed on each of the right and left walls 55 of the fuse block body 52 below the relief slits 56. The retaining projections function to engage an engagement frame 18 of the fuse holder 51. The fuse holder 51 is provisionally retained in the block body 52 as shown in FIG. 10. In this condition, when the fuse holder 51 is further pushed in, the male tab terminals 31 of the fuses 8 are inserted through an opening 57 (see FIG. 9), formed in the block body 52, into terminal receiving chambers 58, respectively, so as to be connected to the female terminals 13, respectively.

However, in those vehicles for domestic use, the dark current fuses 8 are not used. Accordingly, fuses for normal circuits are inserted directly into the block body 52 without requiring the dark current fuses 8 to be withdrawn from and inserted into the connection terminals 13. In such a case, since the strength of the block body 52 is reduced because of the provision of the slits 56 in the outer walls 55, the outer walls 55 can be flexed upon application of an external force, so that the fuses may inadvertently be forced out. To avoid this, the fuse holder 51 must still be used for the purpose of protecting the fuses, and therefore the cost for the fuse holder cannot be saved.

SUMMARY OF THE INVENTION

With the above problems in view, it is an object of this invention to provide a fuse connection structure in which when connection fuses for normal circuits other than dark current circuits are used instead of dark current fuses, these connection fuses can be positively fixed to a fuse block body in a protected manner without the use of a fuse holder.

The above object has been achieved by a fuse connection structure of the invention which comprises a fuse holder adapted to receive and retain dark current fuses therein; and a fuse block body to which the fuse holder can be attached, the fuse block body having connection terminals for the dark current fuses, the fuse holder including a dark current fuse insertion portion holding widthwise opposite ends of the dark current fuses, a cover portion provided outside of the fuse insertion portion, and ribs interconnecting the fuse insertion portion and the cover portion, and the fuse block body having relief portions for the ribs; wherein the ribs extend in a direction of a thickness of the dark current fuse relative to the dark fuse insertion portion; and the fuse block body has protective walls opposed respectively to the widthwise opposite ends of each of the fuses so that the protective walls do not include a relief portion. The fuse block body has fuse-fixing ribs for acting on opposite sides of fuses, the opposite sides facing away from each other in a direction of a thickness of the fuse.

When the fuses are directly connected to the fuse block body without the use of the fuse holder, the widthwise opposite ends of the fuses are protected by the protective walls. Additionally, the opposite sides of the fuse facing the relief portion for the ribs are firmly held by the fuse-fixing ribs.

DETAILED DESCRIPTION OF THE PREFERRED EMBODIMENTS

Figure 1:
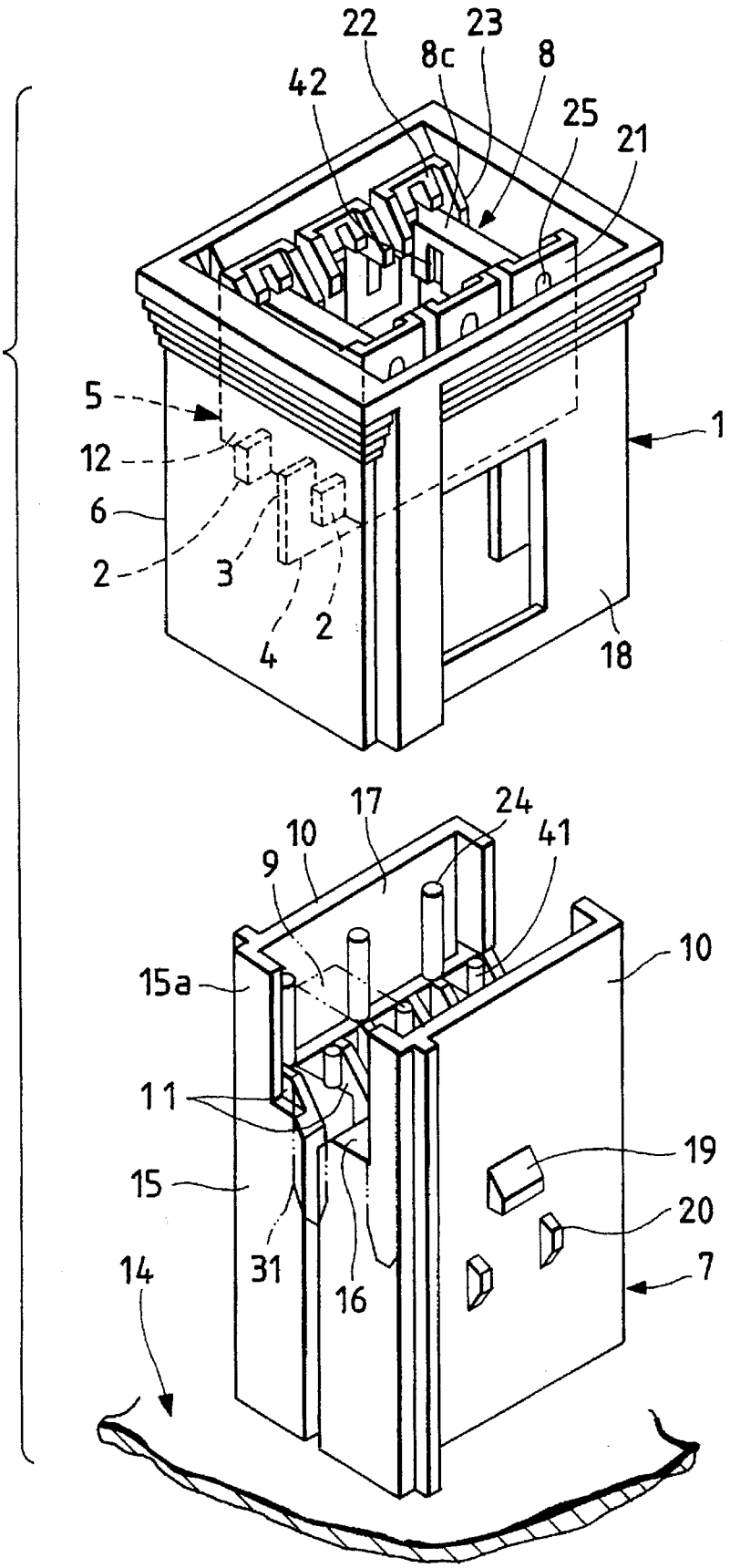
FIG. 1 is an exploded, perspective view of one preferred embodiment of a fuse connection structure of the invention.
Figure 7:
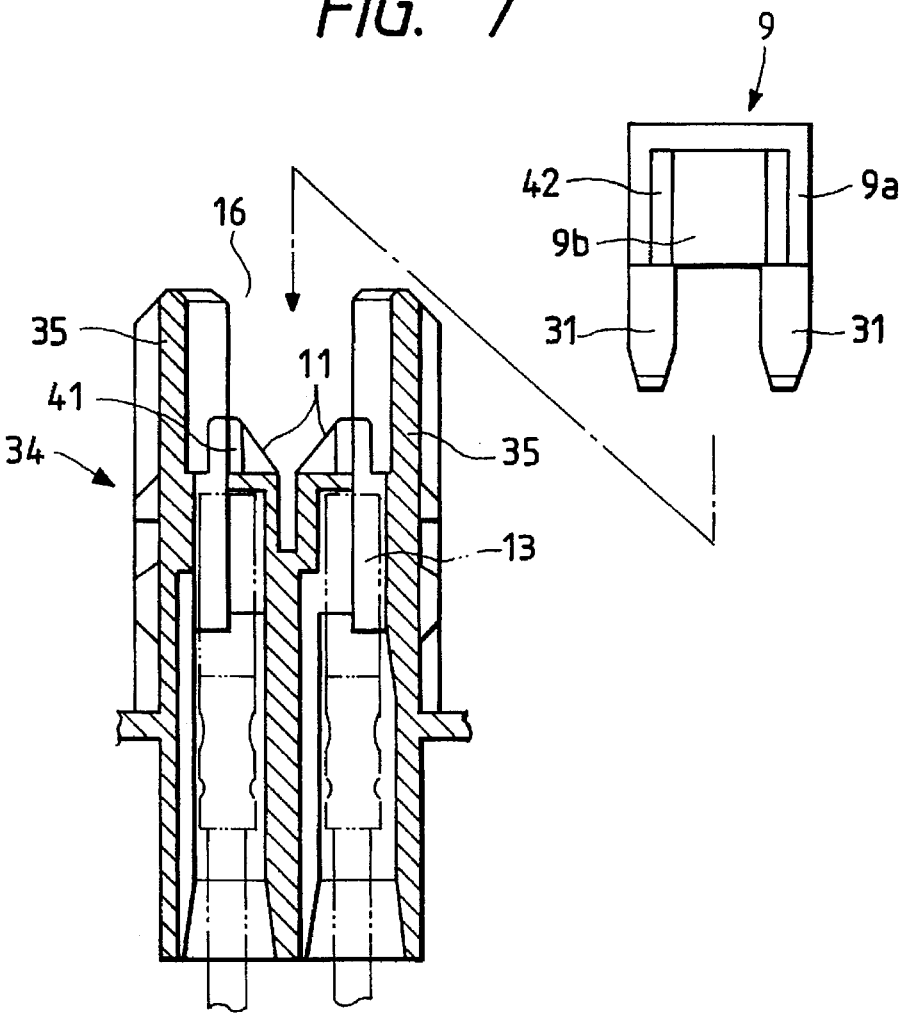
FIG. 7 is a cross-sectional view taken along the line 7—7 of FIG. 5.

FIG. 1 illustrates a preferred embodiment of a fuse connection structure of the present invention. In this structure, connecting ribs 2 and 3 are formed on a fuse holder 1 made of a synthetic resin, and extend in a direction of thickness of dark current fuses, and a dark current fuse insertion portion 5 and a cover portion 6 are interconnected by the ribs 2 and 3. A fuse block body 7, made of a synthetic resin for receiving the fuse holder 1, includes protective walls 10 for protecting widthwise opposite ends 9*a* (see FIG. 7) of fuses 9 (for normal circuits), and fixing ribs 11 for fixing opposite sides 9*b* (facing away from each other in a direction of the thickness of the fuse as shown in FIG. 7) of the fuses 9.

The pair of connecting ribs 2 are formed on a lower portion of each of front and rear walls 12, which are spaced from each other in the fuse thickness direction, of the dark current fuse insertion portion 5 provided at the upper half portion of the fuse holder 1. Formed between the pair of ribs 2 and 2 is a flexure prevention rib 4 for retaining lances (not shown) of connection terminals 13 (see FIG. 7) in the fuse block body 7. Opposite ends of the flexure prevention rib 4 also serve as the connecting ribs 3.

The fuse block body 7 is provided upright in an electric connection box 14, and a relief notch 16 for receiving the connecting ribs 2 and 3 is formed in each of front and rear walls 15 of the fuse block body 7 spaced from each other in the fuse thickness direction. A pair of reinforcing walls 15*a* are formed on opposite sides of the relief notch 16, respectively, and each reinforcing wall 15*a* is connected perpendicularly to the corresponding protective wall 10. A fuse receiving space 17 is formed between the two protective walls 10 and 10. The protective walls 10 protect, from an external force, the widthwise opposite ends 9*a* of the normal circuit fuses 9 which are inserted directly into the fuse block body 7 when the dark current fuses 8 are not used. Retaining projections 19 and 20 for engagement with an engagement frame 18 of the cover portion 6 of the fuse holder 1 are formed on a lower portion of the protective wall 10. The fuse insertion portion 5 of fuse holder 1 has elastic walls 21 for retaining widthwise opposite ends of the dark current fuses 8, and retaining projections 22 and guide projections 23 for retaining and guiding a fuse head portion 8*c* are formed on an inner surface of the elastic wall 21. An engagement groove 25 for receiving a corresponding elongate guide projection 24 on the inner surface of the protective wall 10 is formed in an outer surface of the elastic wall 21.

Figure 2:
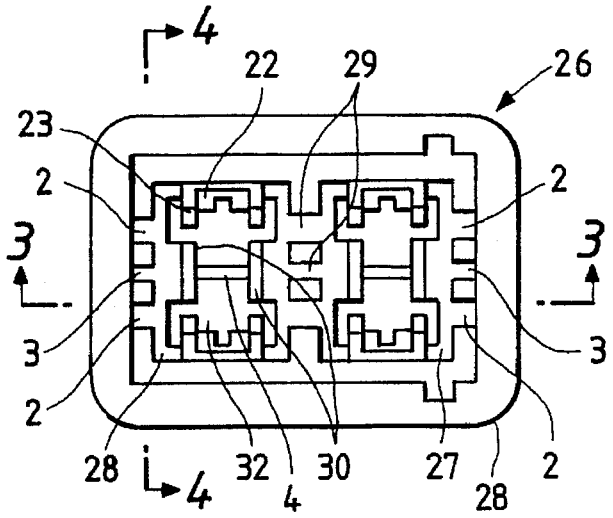
FIG. 2 is a plan view of a fuse holder of another embodiment of the invention (in which two fuses are juxtaposed)
Figure 3:
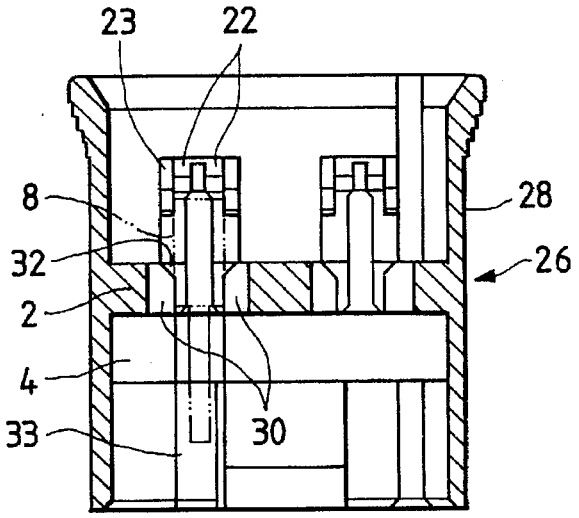
FIG. 3 is a cross-sectional view taken along the line 3—3 of FIG. 2.
Figure 4:
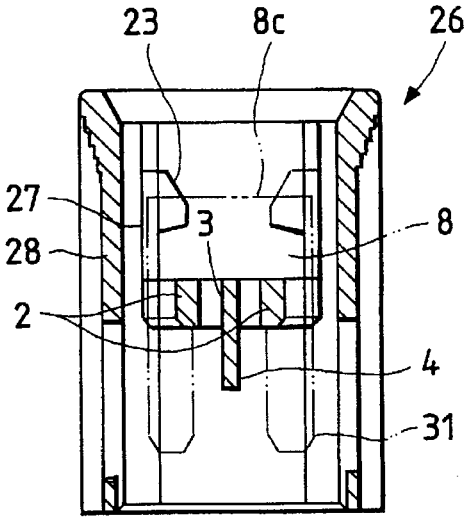
FIG. 4 is a cross-sectional view taken along the line 4—4 of FIG. 2.

FIGS. 2 to 4 show a fuse holder 26 which can hold two dark current fuses 8 in parallel relation to each other. Fuse insertion portions 27 are connected to a cover portion 28 by connecting ribs 2 and 3 in a fuse thickness direction as in the above embodiment, and the fuse insertion portions 27 and 27 are interconnected by ribs 29. Reference numeral 22 denotes retaining projections for retaining a fuse head portion 8*c*, and reference numeral 23 denote guide projections for guiding the fuse head portion 8*c*.

Each dark current fuse 8 is supported by a pair of holder portions 30, which are disposed between the connecting ribs 2 and the intermediate ribs 29, and a flexure prevention rib 4. The fuse head portion 8*c* is stably supported by the retaining projections 22. A pair of male tab terminals 31 of the dark current fuse 8 project into a lower chamber 33 of the cover portion 28 through a lower opening 32.

Figure 5:
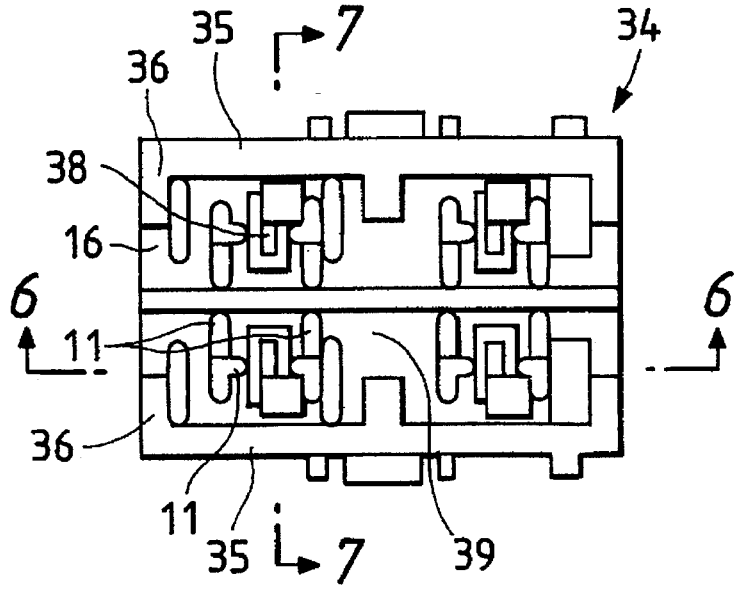
FIG. 5 is a plan view of a fuse block body for the fuse holder of FIG. 2.
Figure 6:
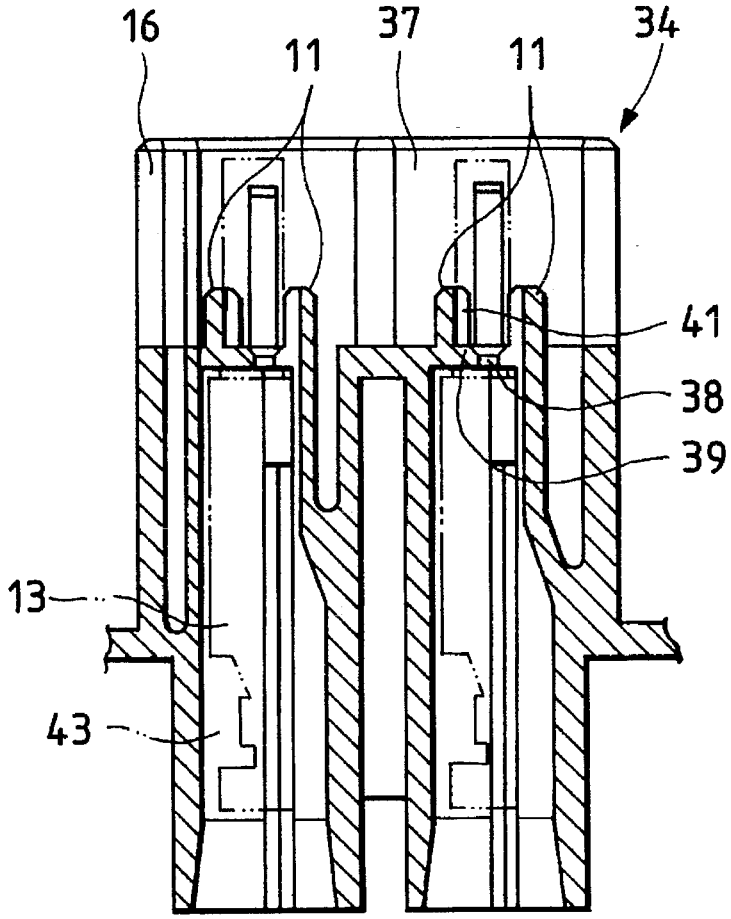
FIG. 6 is a cross-sectional view taken along the line 6—6 of FIG. 5.

FIGS. 5 to 7 show a fuse block body 34 for the above fuse holder 26. As in the embodiment of FIG. 1, a fuse receiving space 37 is formed between right and left protective walls 35 and 35 and between front and rear reinforcing walls 36, as shown in FIG. 6 which is a cross-sectional view taken along the line 6—6 of FIG. 5. A partition wall 39 is provided at the bottom of the fuse receiving space 37, and has insertion holes 38 each for passing a male tab terminal 31 of a fuse 9 therethrough. Pairs of opposed, upstanding front and rear fuse-fixing ribs 11 are formed on the partition wall 39, and each pair of ribs 11 supports a body portion of the associated fuse.

The fuse-fixing rib 11 extends from a region, corresponding to a widthwise end 9*a* of the fuse 9, toward a region corresponding to a widthwise central portion of the fuse 9. An elongate guide projection 41 for engagement in an engagement groove 42 in the fuse body portion is formed integrally on a widthwise central portion of an inner surface of the fuse-fixing rib 11. The elongate guide projection 41 is disposed perpendicular to the fixing rib 11, and prevents lateral movement of the fuse. The fuse-fixing rib 11 has a generally triangular shape, and has a slanting surface slanting toward the central portion of the block body, as shown in FIG. 7 which is a cross-sectional view taken along the line 7—7 of FIG. 5.

Figure 8:
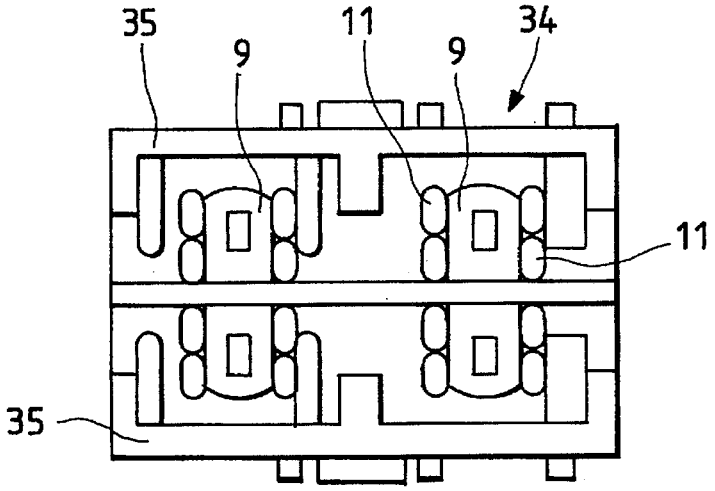
FIG. 8 is a plan view showing a condition in which fuses are attached.
Figure 9:
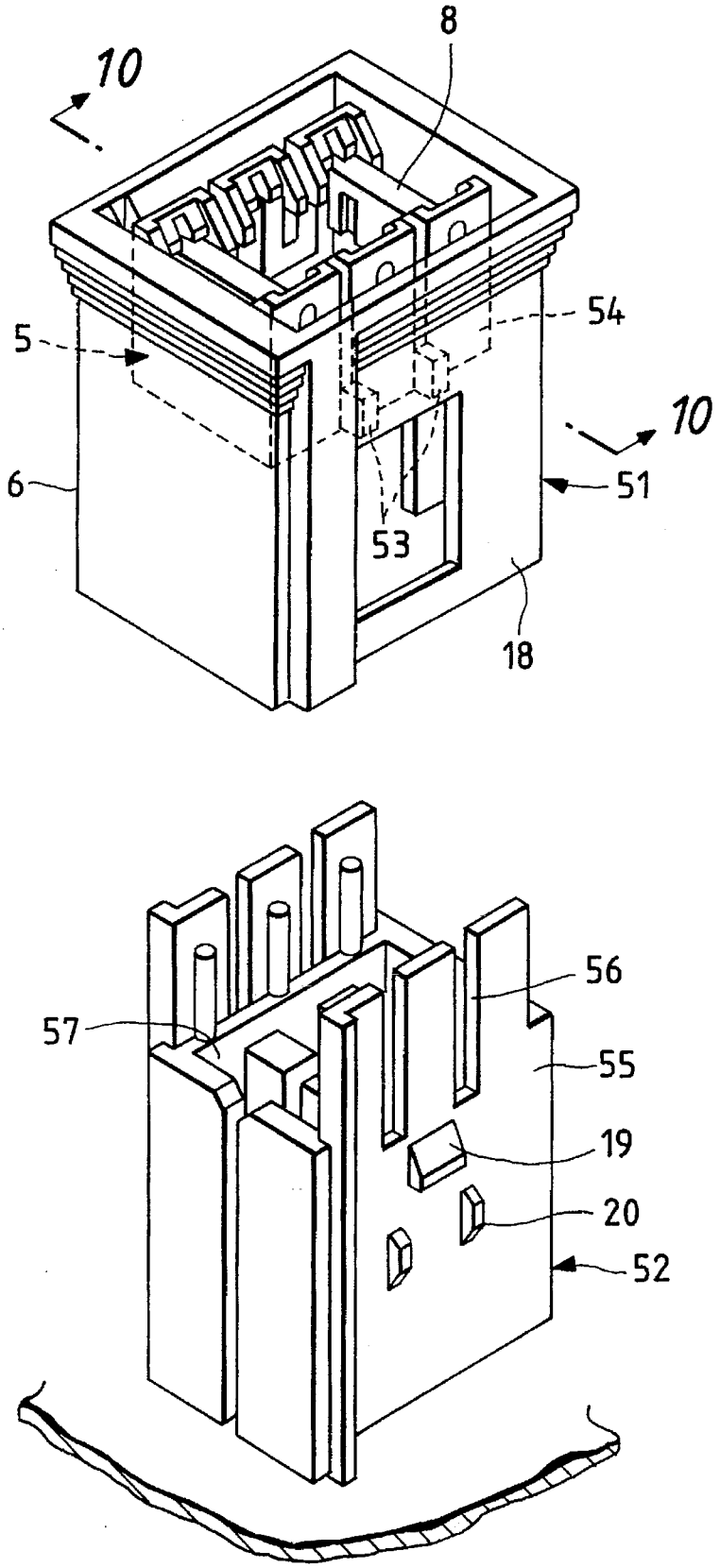
FIG. 9 is an exploded, perspective view of a conventional structure.
Figure 10:
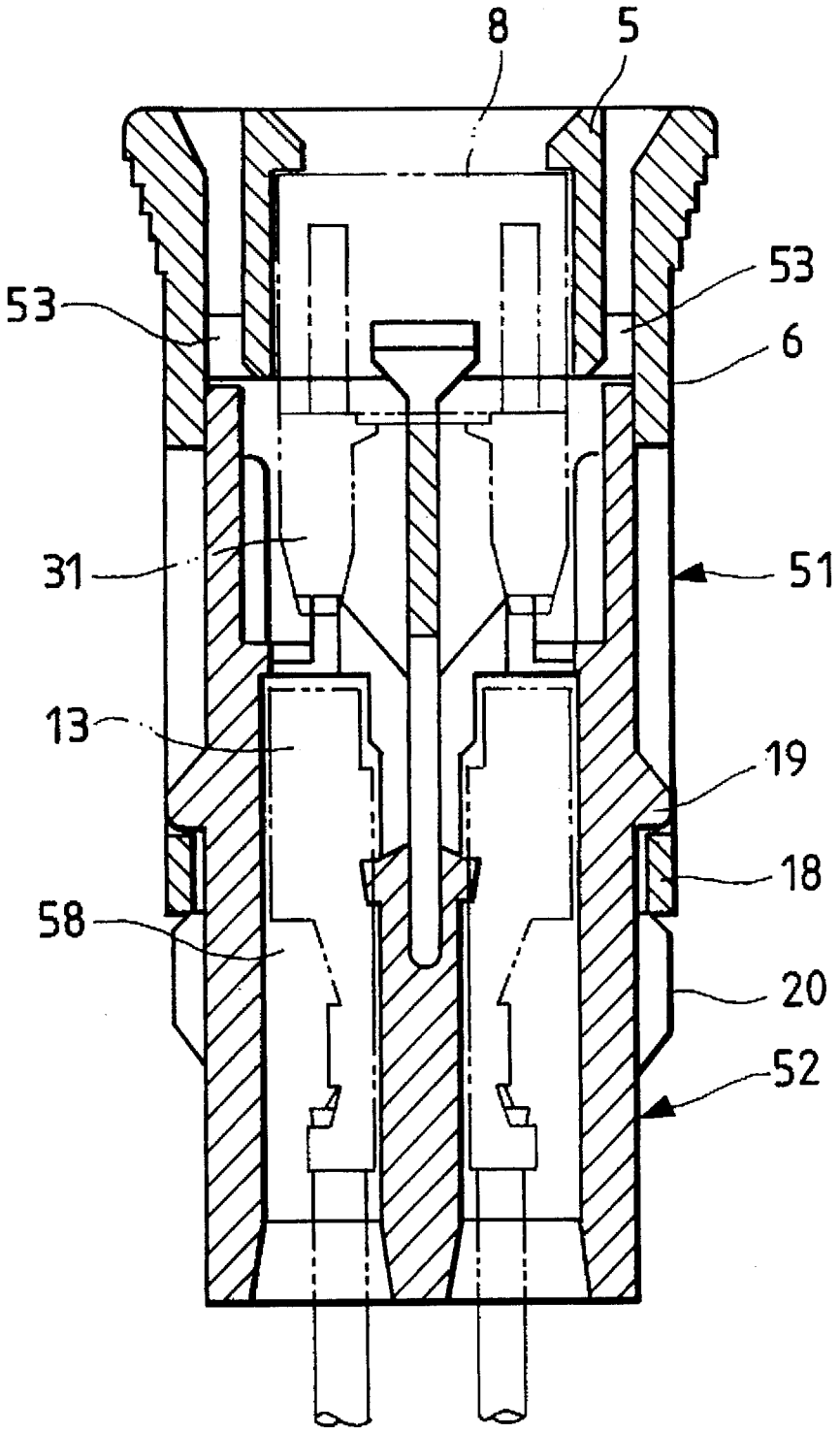
FIG. 10 is a cross-sectional view taken along the line 10—10 of FIG. 9, showing a fused holder in its provisionally-retained condition.

The fixing ribs 11 positively hold the normal circuit fuse 9 without the use of the fuse holder 26, as shown in FIG. 8, and fix the fuse 9 to prevent the same from becoming disengaged as a result of interference from the exterior through a relief notch 16 facing the side or face 9*b* of the fuse 9. As shown in FIG. 6, a receiving chamber 43 for receiving female connection terminals 13 is provided below the partition wall 39 having the fixing ribs 11, and the male tab terminals 31 of the fuses 9 are connected to the female connection terminals 13, respectively.

As described above, in the present invention, in those vehicles or the like for domestic use, in which dark current fuses are not used, and instead the normal circuit fuses are used, protective walls of high rigidity protect the latter fuses from an external force even without the use of the fuse holder. Additionally, these fuses are firmly fixed relative to the fuse block body by the fixing ribs. Therefore, the cost associated with the fuse holder as well as the time and labor for mounting the fuse holder, is saved.

We claim:

1. A fuse connection structure, comprising:

a fuse holder for receiving a dark current fuse, said fuse holder including a dark current fuse insertion position holding opposite lateral ends of said dark current fuse with said lateral ends extending in a first direction, a cover portion provided outside of said fuse insertion portion, a flexure prevention member extending in a second direction at a lower portion of said fuse insertion portion and having opposite ends connected to said cover portion, and ribs interconnecting said fuse insertion portion and said cover portion; and a fuse block body to which said fuse holder is attachable, said fuse block body having connection terminals for connecting with said dark current fuses and having relief portions in opposite first walls thereof for respectively receiving said ribs of said fuse holder;

wherein said ribs extend in the second direction, perpendicular to said first direction, corresponding to a direction of thickness of said dark current fuse, wherein said flexure prevention member operates to restrict movement of said connection terminals, and wherein said fuse block body has protective second walls which are perpendicular to said first walls and which extend in said second direction so as to respectively oppose said lateral ends of said fuse.

2. The fuse connection structure according to claim 1, wherein said fuse block body has fuse-fixing ribs for contacting opposite sides of fuses, said opposite sides opposing each other in said first direction.

3. The fuse connection structure of claim 1, wherein said fuse insertion portion receives a plurality of said dark current fuses.

4. The fuse connection structure of claim 1, further comprising securing means for securing said fuse holder to said fuse block body.

5. The fuse connection structure of claim 4, wherein said securing means includes means for securing said fuse holder in a provisionally engaged position with respect to said fuse block body and a completely engaged position with respect to said fuse block body.

6. The fuse connection structure of claim 1, wherein said fuse block body further includes fuse fixing means for retaining a standard fuse inside said fuse block body without said fuse holder.

7. The fuse connection structure of claim 6, wherein said fuse fixing means includes a rib.

8. The fuse connection structure of claim 7, wherein said rib has an inclined upper surface to facilitate insertion of said standard fuse into said fuse block body.

* * * * *